US007016850B1

(12) United States Patent
Cox et al.

(10) Patent No.: US 7,016,850 B1
(45) Date of Patent: Mar. 21, 2006

(54) METHOD AND APPARATUS FOR REDUCING ACCESS DELAY IN DISCONTINUOUS TRANSMISSION PACKET TELEPHONY SYSTEMS

(75) Inventors: Richard Vandervoort Cox, New Providence, NJ (US); David A Kapilow, Berkeley Heights, NJ (US)

(73) Assignee: AT&T Corp., New York, NY (US)

( * ) Notice: Subject to any disclaimer, the term of this patent is extended or adjusted under 35 U.S.C. 154(b) by 934 days.

(21) Appl. No.: 09/769,119

(22) Filed: Jan. 25, 2001

Related U.S. Application Data

(60) Provisional application No. 60/178,094, filed on Jan. 26, 2000.

(51) Int. Cl.
*G10L 21/04* (2006.01)
*G10L 19/00* (2006.01)

(52) U.S. Cl. ..... 704/503; 704/504; 704/201; 704/211; 379/88.07

(58) Field of Classification Search ..... 340/7.28; 370/355; 455/72; 704/200, 203, 215, 201, 704/227, 278, 288, 270, 503, 504
See application file for complete search history.

(56) References Cited

U.S. PATENT DOCUMENTS 3,104,284 A * 9/1963 French et al. ..... 704/203
5,216,744 A * 6/1993 Alleyne et al. ..... 704/200
5,386,493 A 1/1995 Degen et al.
5,555,447 A * 9/1996 Kotzin et al. ..... 455/72
5,699,404 A * 12/1997 Satyamurti et al. ..... 340/7.28
5,706,393 A * 1/1998 Ehara ..... 704/215
5,796,719 A 8/1998 Peris et al.
6,356,545 B1 * 3/2002 Vargo et al. ..... 370/355

OTHER PUBLICATIONS

Real-time implementation of time domain harmonic scaling of speech for rate modification and coding□□Cox, R.; Crochiere, R.; Johnston, J.; Acoustics, Speech, and Signal Processing, IEEE Transactions on, vol. 31, Iss. 1, Feb. 1983, pp.: 258-272.*
High quality time-scale modification for speech□□Roucos, S.; Wilgus, A. □□Acoustics, Speech, and Signal Processing, IEEE International Conference on ICASSP '85., vol. 10, Iss., Apr. 1985, pp.: 493-496.*

* cited by examiner

*Primary Examiner*—David L. Ometz
*Assistant Examiner*—Brian L. Albertalli

(57) ABSTRACT

Speech at the beginning of a talkspurt in a discontinuous transmission (DTX) packet telephony system is speeded up to help make up for an access delay incurred during channel allocation. Incoming speech frames are buffered, a pitch period for a current portion of the signal is estimated, and then a pitch period=s worth of the signal is cut from that portion. This is continued until the original access delay, as estimated from the time lag between the commencement of voice input for the talkspurt, and notification that a channel is available, is eliminated. The remainder of the talkspurt is then transmitted without such compression.

17 Claims, 8 Drawing Sheets

METHOD AND APPARATUS FOR REDUCING ACCESS DELAY IN DISCONTINUOUS TRANSMISSION PACKET TELEPHONY SYSTEMS

RELATED APPLICATIONS

The present application claims priority to U.S. Provisional Application No. 60/178,094, filed Jan. 26, 2000.

TECHNICAL FIELD

The present invention is related to methods and devices for use in cell phones and other communication systems that use statistical multiplexing wherein channels are dynamically allocated to carry each talkspurt. It is particularly directed to methods and devices for mitigating the effects of access delay in such communication systems.

BACKGROUND OF THE INVENTION

In certain packet telephony systems, a terminal only transmits when voice activity is present. Such discontinuous transmission (DTX) packet telephony systems allow for greater system capacity, as compared with systems in which a channel is allocated to a transmitting terminal for the duration of the call, or session.

With reference to FIG. 1, in DTX systems, at the start of each talkspurt, the transmitting device 102, typically a wireless handset, requests a transmission channel from the base station 104. The base station 104, which uses statistical multiplexing for allocating channels, establishes a path via a network 106 and/or intermediate switches 108 to connect to the remote receiving device 110, which may be another handset, conventional land-line phone, or the like.

FIG. 2 presents a block diagram of the principal functions of the transmitting device 102 and the base station 104 in a DTX system. A speaker's voice is received by an audio input port (AIP) 122 where the voice signal is digitally sampled at some frequency fs, typically fs=8 kHz. The sampled signal is usually divided into frames of length 10 msec or so (i.e., 80 samples) prior to further processing. The frames are input to a voice activity detector (VAD) 124 and a speech encoder 126. As is known to those skilled in the art, in some devices, the VAD 124 is integrated into the speech encoder 126, although this is not a requirement in prior art systems. In any event, the VAD 124 determines whether or not speech is present and, if so, sends an active signal to the handset's control interface 128. The handset's control interface 128 sends a traffic channel request over the control channel 130 to the traffic channel manager 132 resident in the base station 104. In response to the request, the traffic channel manager 132 eventually sends back a traffic channel grant to the handset=s control interface 128, using the control channel 130. Upon receiving the traffic channel grant, the handset's control interface notifies the VAD 124, the speech encoder 126 and/or the handset's bit-stream transmitter 134 that a traffic channel 136 has been allocated for transmitting voice data. When this happens, the speech encoder 126 encodes the speech frames and sends the encoded speech signal to the handset's bit-stream transmitter 134 for transmission over the traffic channel 136 to the appropriate bit-stream receiver 138 associated with the base station 104. In some devices, the speech encoder 126 prepares frames for transmission and sends these to the bit-stream transmitter, whether or not there is voice information to be transmitted. In such case, the transmitter does not transmit until it receives a signal indicating that the traffic channel 136 is available.

In the above-described conventional system, there is delay between the time that frames emerge from the audio input port and the bit-stream transmitter 134 begins to transmit voice data. The overall delay includes a first delay associated with the time that it takes the VAD to detect that voice activity is present and notify the handset's control interface prior to the traffic channel request, the VAD delay, and a second delay associated, with the time between the traffic channel request and the traffic channel grant, the channel access delay. The length of the VAD delay is fixed for a given handset, and depends on such things as the frame length being used. The length of the channel access delay, however, varies from talkspurt to talkspurt and depends on such factors as the system architecture and the system load. For example, in the wireless voice over EDGE (Enhanced Data for GSM Evolution) system, the channel access delay is approximately 60 msec, and possibly more. Conventionally, mitigating any type of access delay entails either a) buffering the voice bit-stream until permission is granted, and thereby retarding transmission by that amount of time, b) throwing away speech at the beginning of each utterance ((i.e., front-end clipping until permission is granted, or c) a combination of the two approaches. The buffering option introduces delay, which is detrimental to the dynamics of interactive conversations. Indeed, adding 120 msec of round trip delay just for access delay can break the overall delay budget for the system. The front-end clipping option often cuts off the initial consonant of each utterance, and thus hurts intelligibility. Finally, combining the two options such that less clipping occurs at the expense of delay is less than satisfactory because such an approach suffers from the disadvantages of both.

SUMMARY OF THE INVENTION

The present invention is directed to a method and system for removing access delay during the beginning of each utterance as the talkspurt progresses. This is done by time-scale compressing, i.e., speeding up, the speech at the start of a talkspurt before it is passed to the speech coder. The speech is speeded up by buffering each talkspurt, estimating the speaker's pitch period, and then deleting an integer number of pitch periods worth of speech from the buffered talkspurt to produce a compressed talkspurt. The compressed talkspurt is then encoded and transmitted until the access delay has been fully mitigated, after which the incoming voice signal is passed through without further compression for the remainder of the talkspurt.

BRIEF DESCRIPTION OF THE DRAWINGS

The present invention can better be understood through the attached figures in which.

DETAILED DESCRIPTION OF THE INVENTION

Figure 1:
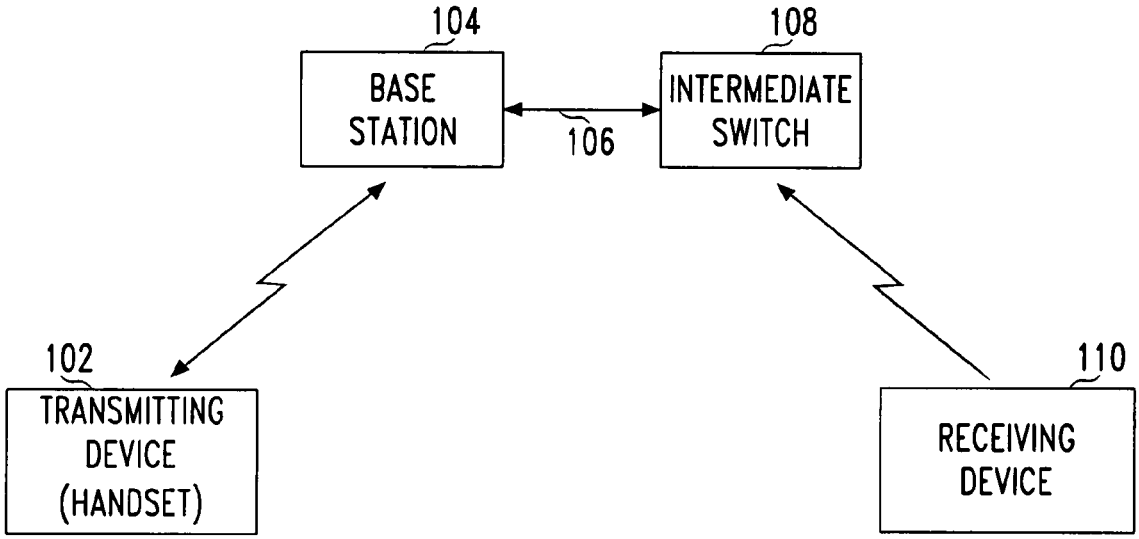
FIG. 1 PRIOR ART
FIG. 1 shows a conventional communication system to which the present invention pertains.
Figure 2:
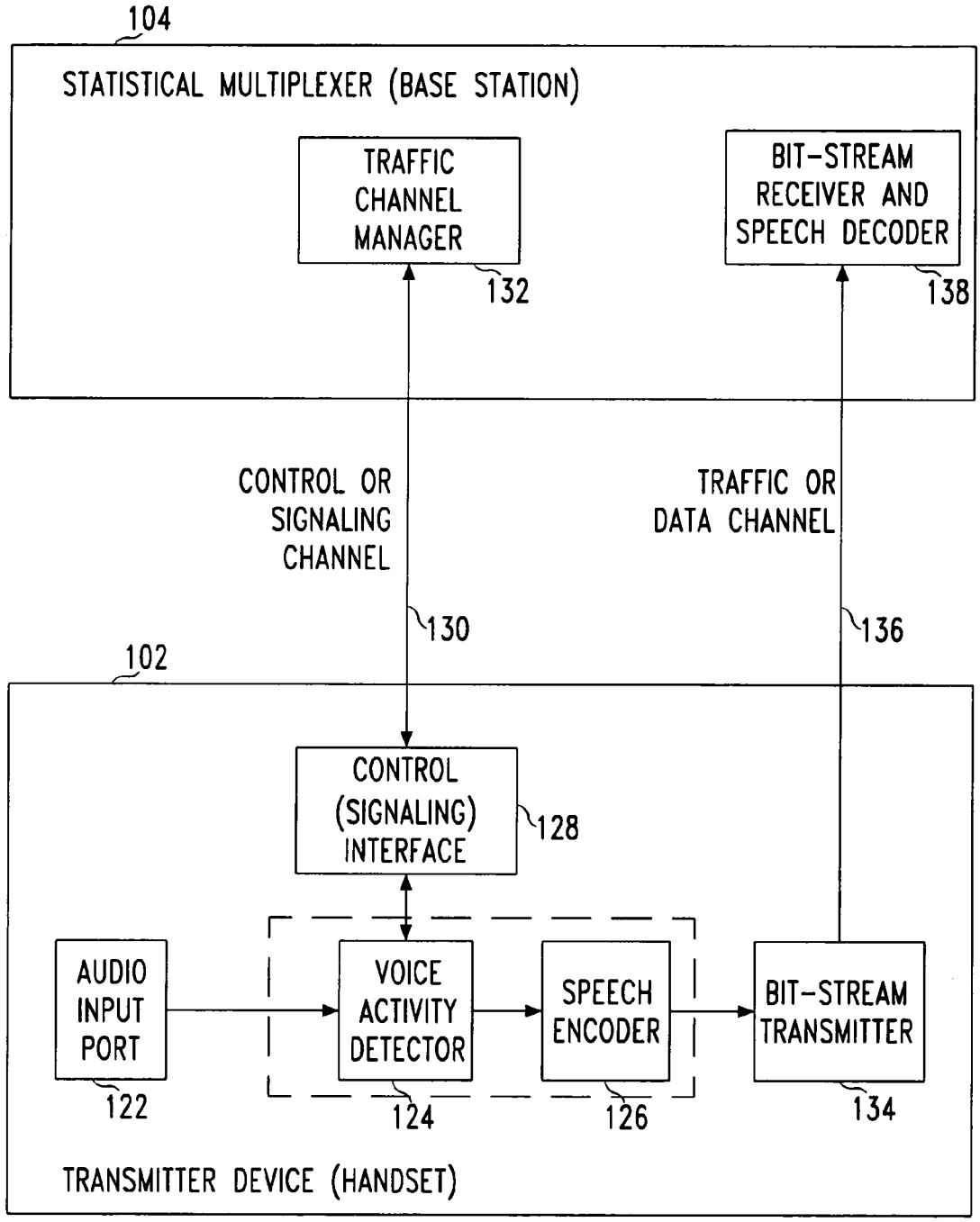
FIG. 2 PRIOR ART
FIG. 2 shows a functional block diagram of pertinent portions of a conventional transmitter.
Figure 3:
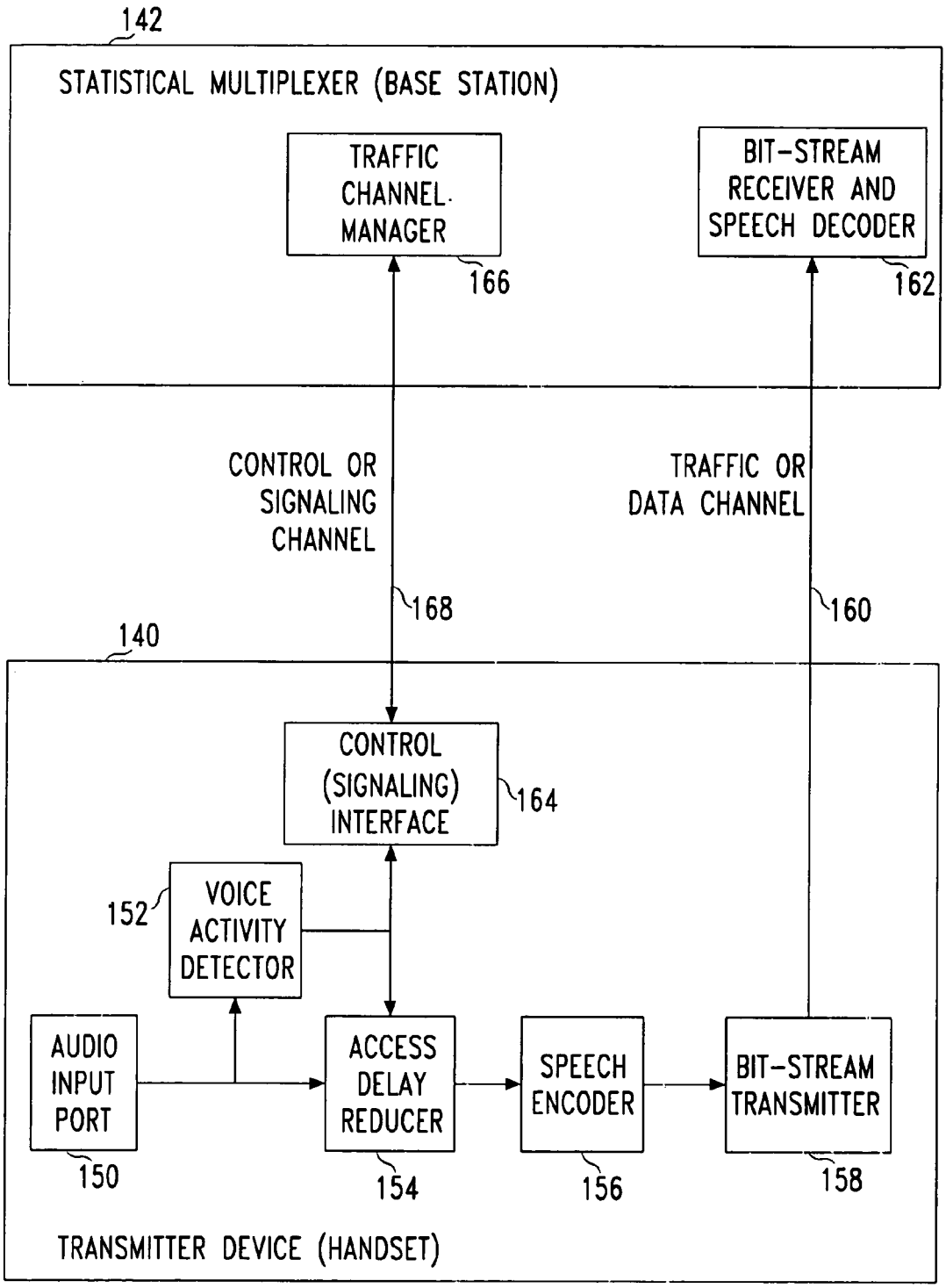
FIG. 3 shows a functional block diagram of pertinent portions of a communication device in accordance with the present invention.

With reference to the communication device 140 and the base station 142 of FIG. 3, a speaker speaks into the AIP 150 which, in turn, outputs frames of speech. The frames of speech are input to both the Voice Activity Detector (VAD) 152 and the Access Delay Reducer (ADR) 154. The VAD makes a binary yes/no decision as to whether or not each input frame contains voice activity. If voice activity is detected, the speech frames are encoded by the speech encoder 156 and transmitted by the bit-stream transmitter 158 via the traffic channel 160 to the bit-stream receiver 162 of the base station. On the other hand, when the VAD 152 detects no voice activity, the bit-stream transmitter 158 transmits no voice signal, although it may still transmit frames for comfort noise generation (CNG), such as described in U.S. Pat. No. 5,960,389, during such periods of inactivity so that the background noise at the receiver matches that at the transmitter.

The VAD 152 outputs an active signal, which indicates an inactive-to-active transition, both to the handset's control interface 164 and the ADR 154, thereby signifying that voice frames are present. The handset=s control interface 164, in turn, informs the traffic channel manager 166 via the control channel 168 that a traffic channel is needed to send the bit-stream. The traffic channel manager 166, in turn, locates and allocates an available traffic channel and, after the access delay, Da, informs the handset=s control interface 164 by sending an appropriate message back over the control channel 168, which is sent on to the ADR 154. The traffic channel is requested and assigned by the traffic channel manager 166 at the start of each talkspurt. At the end of each talkspurt, the VAD 152 detects that no further speech is being generated, and sends an appropriate signal to the handset's control interface 164 which, in turn, informs the traffic channel manager 166 that the assigned traffic channel is no longer needed and now may be reused.

When the ADR 154 receives the active signal from the VAD 152, it starts buffering the frames of speech in an internal buffer. And when the ADR 154 receives the signal from the control interface 164, it can determine the access delay Da. This can be done, for example, by use of a real time clock/timer associated with the communication device, or by measuring a >current position=pointer in the AIP 150 both upon receiving the active signal (>voice present=) from the VAD 152 and also upon receiving the second signal (>channel established=), and taking the difference. In general the particular manner in which the ADR obtains the channel delay is not critical, so long as it has access to this information.

In the present invention, the ADR 154 is configured to speed up the speech at the beginning of each utterance so as to make up for the access delay Da within some time period T. This is accomplished by compressing the speech by some speed-up rate r during the time period T. The speed-up rate r at which the access delay Da is mitigated is given by r=Da/T. It should be noted, however, that the speed-up rate r is a tunable parameter which may be selected, given latitude in adaptively determining T, upon ascertaining the delay access Da. Higher speed-up rates remove the access delay faster, but at the expense of noticeably more distorted output speech. Lower speed-up rates are less noticeable in the output speech, but take longer to remove the delay. Preferably, 0.08<r<0.15, and most preferably r.0.12, or 12%. Thus, in the most preferred embodiment, an access delay of Da=60 msec is mitigated in a time scaling interval T=500 msec, preferably near the beginning of each talkspurt. Should the utterance then continue, no further mitigation is required since the time-scale compression during the time period T would have accounted for the entire access delay. The output of the ADR 154 is sent to the speech encoder 156 in preparation for transmission by the bit-stream transmitter 158.

To maintain proper signal phase in voiced regions, preferably, only segments that are an integer number of estimated pitch periods are cut from the signal. In regions with long pitch periods where only a little bit needs to be removed, the cutting is deferred until the pitch period drops. Thus, it may take a little longer than a predetermined time-scaling interval T allotted for fully mitigating the access delay.

In the context of the present invention, the VAD 152 preferably is external to the speech encoder 156, rather than being part of the speech encoder, as in conventional implementations. This is because the speech must be time-scaled before it is sent to the speech encoder 156, which requires that the output of the VAD be known before the encoder is called into play. Furthermore, while the ADR 154 could be integrated into an encoder, it is simpler to implement it as a preprocessor. This way, a single ADR implementation may be used with any speech encoder.

Figure 4:
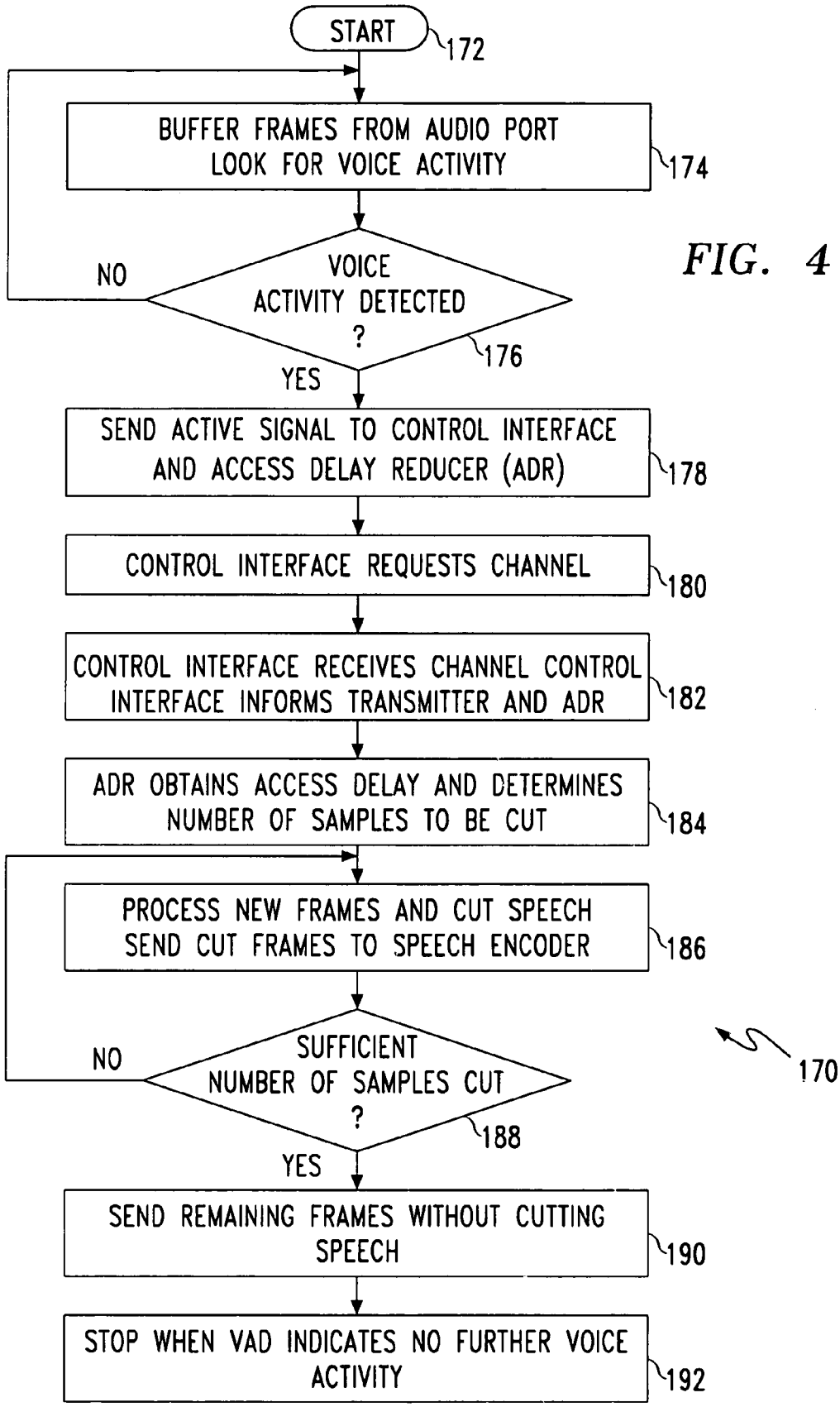
FIG. 4 shows a flow chart governing the operation of the communication device of FIG. 3.

FIG. 4 presents a generalized flow chart 170 of a method to operate the communication device of FIG. 3 in accordance with the present invention. In step 172, the communication device is turned on and the AIP 150 outputs frames of data, whether or not voice is present. In step 174, the VAD 152 and the ADR 154 both receive the frames output by the AIP, with the ADR 154 temporarily buffering the frames, just in case the VAD determines that voice activity was present. In step 176, the VAD 152 checks for voice activity. If no voice activity is detected, additional frames are taken in and buffered and checked. If voice activity is detected, in step 178, the VAD 152 sends an active signal to the control interface 164 and also to the ADR 154. In step 180, the control interface 164 requests a channel and in step 182, informs the ADR 154 and the bit-stream transmitter 158 that a channel has been allocated for the current talkspurt. In step 184, the ADR 154 obtains the access delay and determines the number of samples that it must cut from the talkspurt within the time period T. In step 186, the ADR 154 processes new frames from the AIP 150, cutting samples in accordance with a predetermined algorithm, and sends the cut frames onto to the speech encoder 156 in preparation for transmission. In step 188, the ADR 154 checks to see whether a sufficient number of samples have been cut. If not, control returns to step 176 to process and make cuts in additional frames. If, however, it is determined at step 188 that a sufficient number of samples have been cut, at step 190, the remaining frames are passed through to the encoder without further cutting until, at step 192, the VAD 152 indicates that no further voice activity is being received in that talkspurt.

After the talkspurt is over, an active-to-inactive transition occurs in the VAD 152 and the VAD 152 sends an inactive signal to the handset's control interface 164. When the handset's control interface 164 receives and processes the inactive signal, this ultimately results in the traffic channel 160 being freed for reuse by the base station 142. The handset's control interface 164 then waits for another active signal from the VAD 152, in response to another talkspurt. However, if the talkspurt is very short, e.g., less than the time period T of 500 msec, the system may not have enough time to completely remove the access delay. In this case, the bit-stream transmitter 158 informs the handset's control interface 164 that there is still data to send, which may defer freeing the traffic channel 160 until all the encoded packets have been transmitted.

Figure 5:
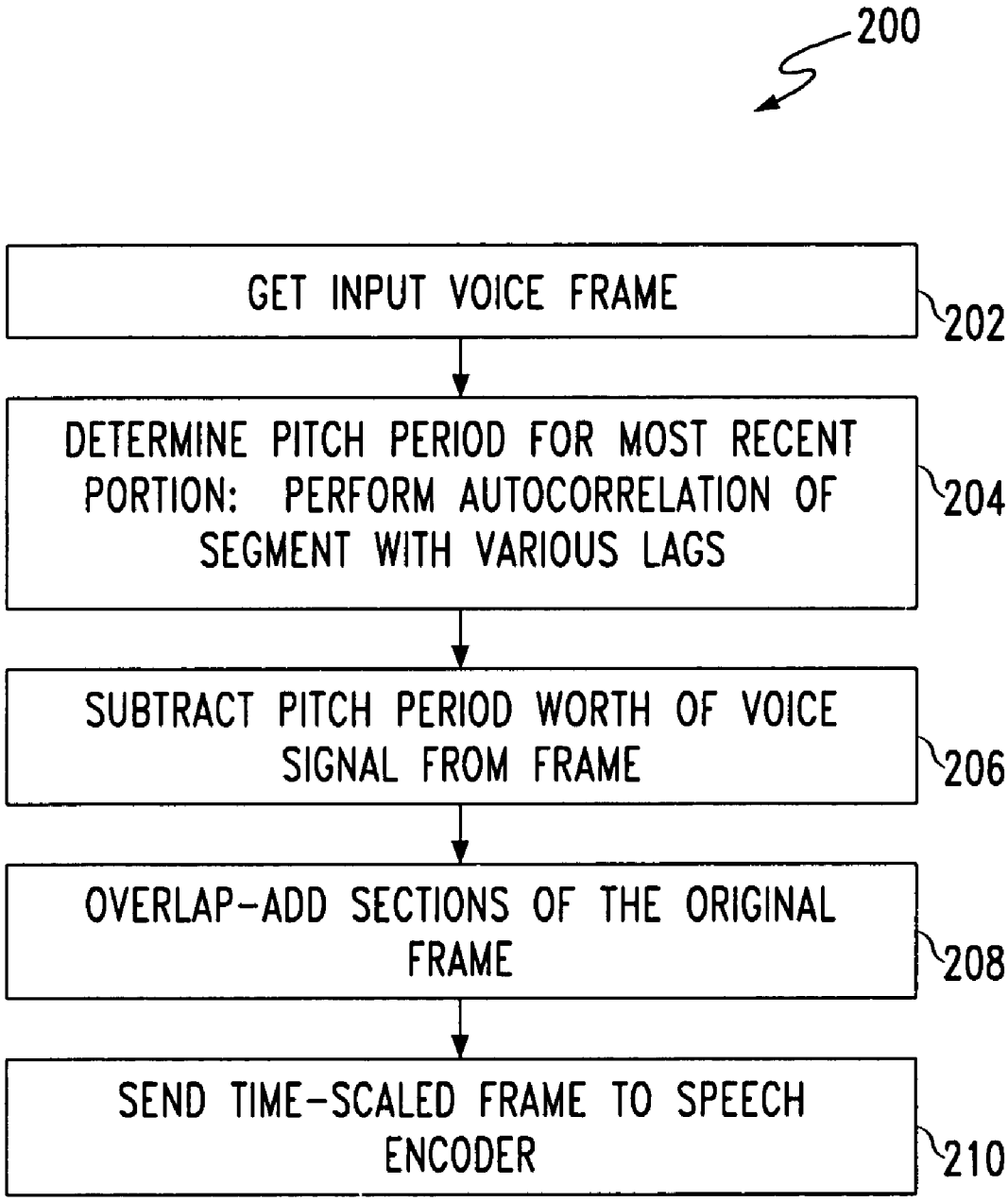
FIG. 5 shows a flow chart detailing the processing of a frame of voice data.

FIG. 5 presents a generalized flow chart 200, illustrating the steps associated with step 186 of FIG. 4. In step 202, the ADR 154 receives a frame from the AIP 150. In step 204, the ADR determines the pitch period P using the most recent portion of the received frame. Preferably, this is done by performing an autocorrelation of a terminal section of the frame, with earlier portions of that frame, and perhaps even earlier frames, by using various lags within some finite range. The lag corresponding to the peak of the resulting autocorrelation output is then taken as the pitch period P. The pitch period estimate P is used even when the speech is unvoiced. In step 206, the ADR subtracts one pitch period P worth of signal from the frame, although integer multiples of a single pitch period may be subtracted, if P is short enough. After the pitch period has been cut, a first segment of the frame located immediately before the cut portion, and a second segment of the frame comprising an endmost portion of the cut portion are merged. As seen in step 208, this is preferably done by an overlap-add technique which mixes the two segments so as to ensure a smooth transition. Finally, in step 210, the cut frame is sent on to the speech encoder 156 in preparation for transmission of the cut frame.

It should be noted here that while the above description focuses on the access delay reducer being found in a handset, a similar functionality could also be found in a base station which must first establish/allocate a traffic channel before relaying a voice signal to the handset, and therefore must buffer and transmit the voice signal. In such case, access delay reduction may be employed in both directions.

The above-described invention is now illustrated through an example which uses human speech, and a simulated communications device. The simulation used a sampling rate of fs=8 kHz, a simulated access delay Da=60 msec, a time-scaling interval T=500 msec, with the speech being processed using a frame length F=20 msec.

Figure 6A:
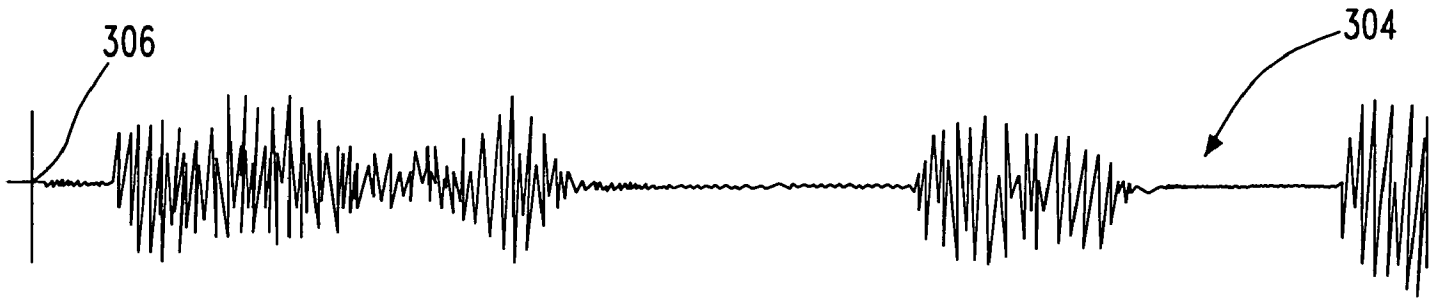
FIGS. 6*a* & 6*b* illustrate the effect of the present invention on a speech waveform.
Figure 6B:
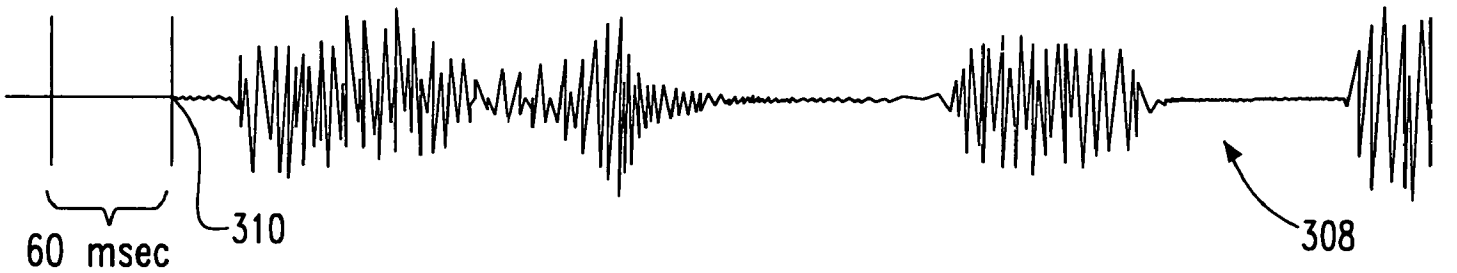

FIGS. 6*a* and 6*b*, present the speech waveforms illustrating the effect of the simulation. The input waveform 304 of FIG. 6*a* shows the unmodified first 750 msecs of a talkspurt input to an audio port. Mark 306 indicates the point at which the VAD 152 has detected an inactive-to-active transition and thus outputs the active signal. The region to the left of mark 306 has been zeroed out, since this signal is not transmitted. The output waveform of 308 of FIG. 6*b* shows the time-compressed output of an ADR delay algorithm which is fed into the speech encoder. The start of the talkspurt has been delayed by a simulated access delay of Da=60 msec. Mark 310 is placed on the output waveform 60 msec after mark 306. A speed-up rate of r=0.12, or 12%, is used so that the 60 msec simulated access delay is mitigated within the time-scaling interval T=500 msec. Thus, the input speech signal 304 is time compressed for the 500 msec after mark 306 to remove the access delay, the result of the compression being shown after mark 310 in the output waveform 308. As seen in FIG. 6*b*, the time-compressed waveform has similar characteristics to the original input waveform, but is shorter by the 60 msec synthetic access delay. However, after the 500 msec catch-up period, the input and time-compressed waveforms are time-aligned.

In the present example, a general purpose VAD based on signal power, such as that described in U.S. Pat. No. 5,991,718, is used. The first few active speech frames from this VAD are placed in buffer associated with the ADR and, for various reasons, are not time-compressed, but rather are sent on to the speech encoder. When the transmission channel is granted, the obtained access delay Da is measured and converted to samples. At a sampling rate of 8 kHz, a simulated access delay Da=60 msecs corresponds to a total of 480 samples that must be removed over the time-scaling interval T=500 msec. This calls for a speed-up rate r=0.12=60 msec/500 msec. Since there are 25 frames of length F=20 msecs in a 500 msec time interval, on average, 480/25=19.2 samples should be removed from each frame. To ensure that the cutting process is on track, two accumulators are kept. One accumulator, called target count Tc, keeps track of how many samples should have been removed by the time the current frame is transmitted. Tc is initially 19.2 (since by the time the first frame is sent, about 19.2 samples should have been cut) and is incremented by 19.2 with each passing frame. The second accumulator, called the remaining count Rc, keeps track of how many more samples must be removed to get rid of the entire access delay. Therefore, in the present simulation, Rc is initially set to 480, and then decreases, each time samples are cut from a frame during the processing.

As discussed above, before subtracting any portion of the signal, a current pitch period was estimated. In the present example, this is performed by finding the lag corresponding to the peak of the normalized autocorrelation of the most recent Lc msecs of speech with varying lengths from Lmin to Lmax msecs= worth of immediately preceding speech, at step intervals of Lint. For the present example, Lc=20 msecs (160 samples at fs=8 kHz), Lmin=2.5 msec (20 samples at fs=8 kHz), Lmax=15 msec (120 samples at fs=8 kHz) and Lint=0.125 msec (1 sample at fs=8 kHz). Thus, the range of allowable pitch periods is established by Lmin and Lmax. To lower the computational complexity, however, the autocorrelation preferably is performed in two stages: first a rough estimate is computed on a 2:1 decimated signal, and then a finer search is performed in the vicinity of the rough estimate with the undedicated signal.

Figure 7:
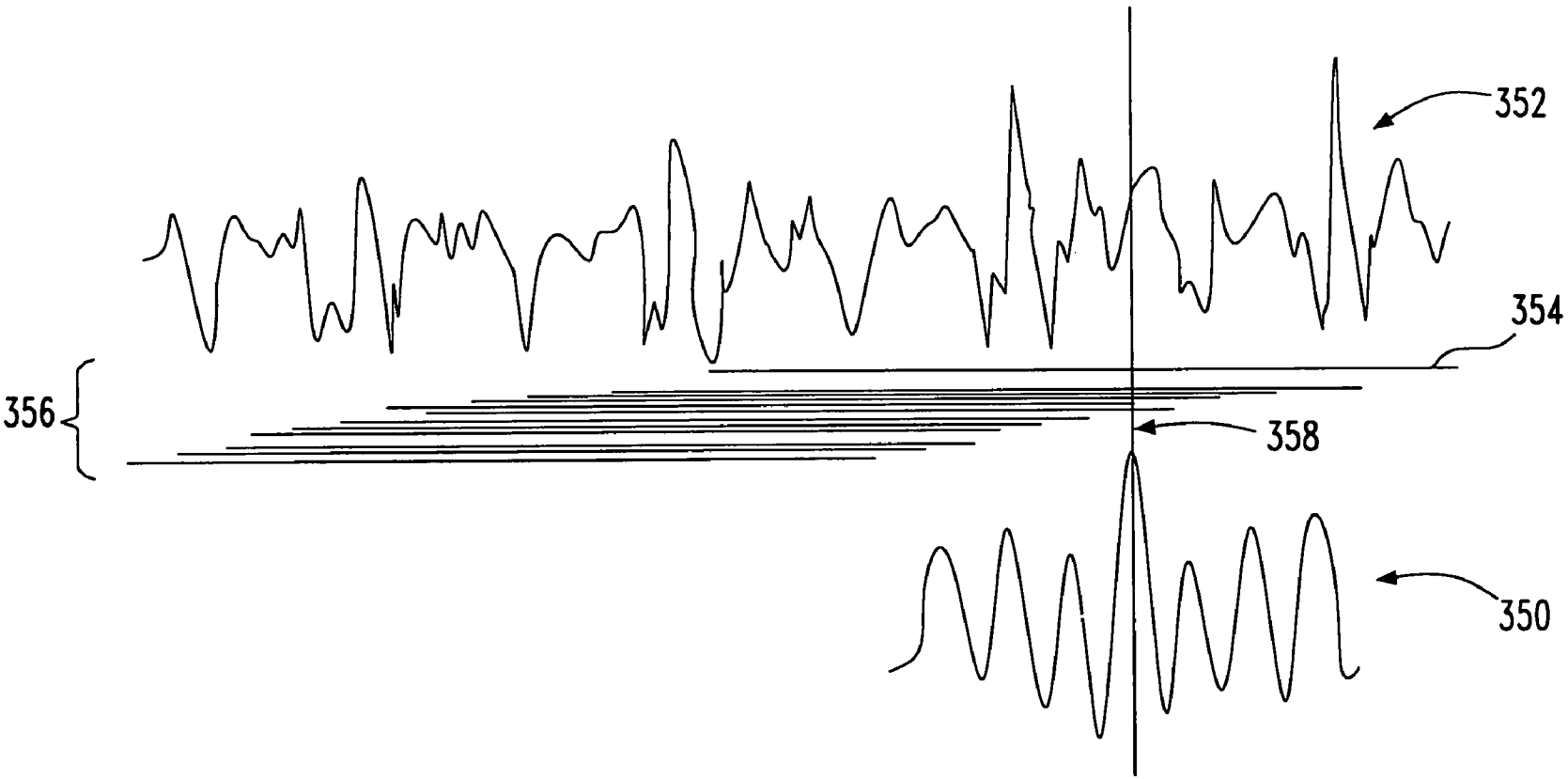
FIG. 7 illustrates the process for estimating the pitch period for a frame of voice data.

FIG. 7 illustrates the autocorrelation result 350 for pitch period estimation on a 35 msec portion 352 of the signal presented in FIG. 6*a*. A 20 msec-long reference 354 and a number of lag windows 356 for the autocorrelation are also shown. In FIG. 7 the autocorrelation result 350 is aligned with the tail end of the lag windows. The autocorrelation peak 358 corresponds to a pitch period estimate of P=8.875 msec (71 samples at 8 kHz) and is positioned one pitch period back from the end of the 35 msec portion 352. The calculated pitch period P, in samples, is compared to the current value of the target count Tc. If P>Tc, which may happen at the beginning of the talkspurt, no time-scaling is performed on the current frame and the next frame from the AIP is processed. If, however, P#Tc, a first portion of signal, having a length substantially equal to the pitch period P, can be removed from the input. Preferably, this first portion is removed from the most recent part of the input signal.

Figure 8:
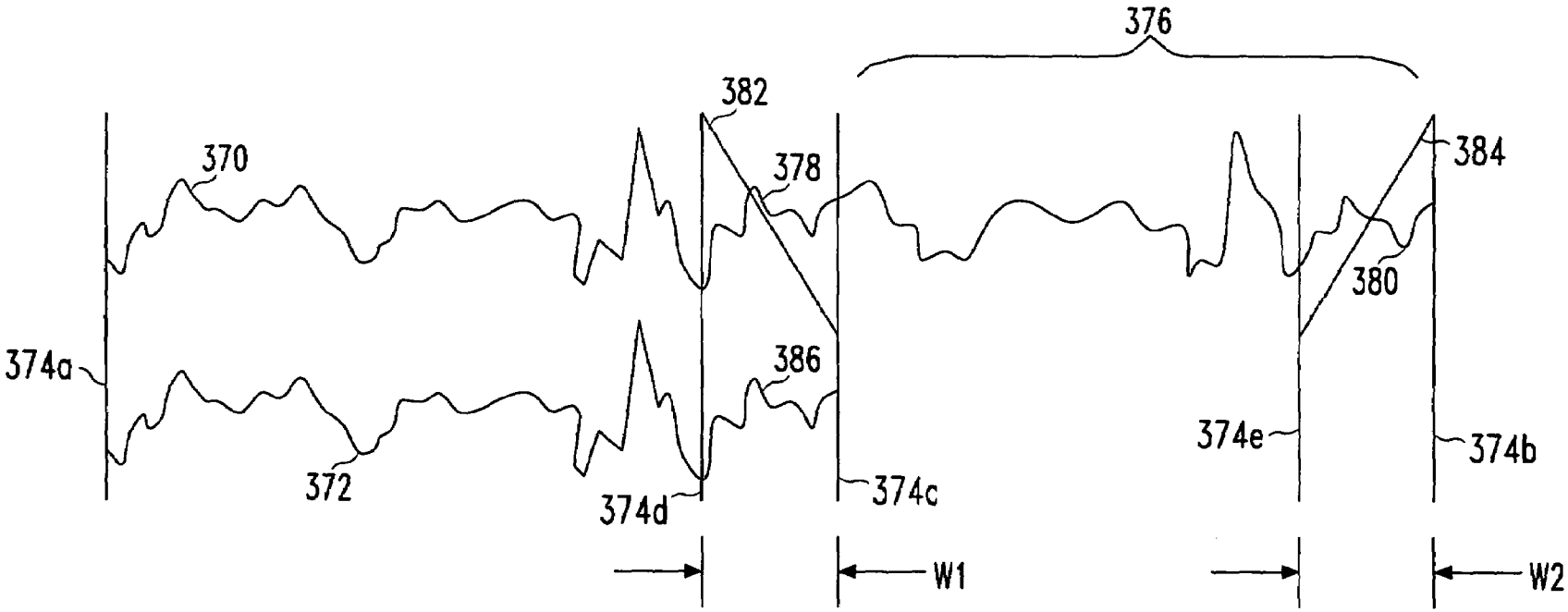
FIG. 8 shows an overlap-add method used in conjunction with removing a pitch period worth of data from frame of voice data.

FIG. 8 shows an overlap-add (OLA) pitch cutting operation for a portion of a speech signal sampled at a sampling rate of 8 kHz. The top waveform shows an original input frame 370 and the lower waveform shows the time-scaled frame 372 after removal of a pitch period and the OLA operation. The input frame 370 has a length 160 samples, or 20 msecs, and extends between demarcation lines 374*a*, 374*b*, which designate the beginning and the end of the input frame 30, respectively. The time-scaled frame 372 extends between demarcation lines 374*a* and 374*c*, and extends for 20 msec minus the length of the removed pitch period. For input frame 370, the pitch period is 71 samples, or 8.875 msecs, and so the time-scaled frame is 89 samples, or 11.125 msecs. As seen in FIG. 8, the 71-sample removed portion 376 of the input frame extends between demarcation lines 374*c* and 37*b*, at the end of input frame.

The OLA operation combines a first segment 378 of the original input frame having a length W1, which preferably is ¼ of a pitch period, with a second segment 380 of the original input frame, also of length W1 using windows 382 and 384, respectively. The first segment 378 belongs to a section of the pitch period immediately preceding the removed portion 376, and the second segment 380 comes from the endmost portion of the removed portion 376 at the terminal section of the frame. The two segments 378, 380 are combined by multiplying by their respective windows and adding the result, to thereby form a smooth, mixed portion 386 of length W1, which forms the terminal part of the time-scaled frame 372. Thus, the forward portion of the time-scaled frame 372, seen extending between demarcation lines 374*a* and 374*d*, is an unmodified copy of the original input frame 370, while the terminal part of the time-scaled frame is a modified copy of a first section of the original input frame delimited by demarcation lines 374*d* and 374*c*, mixed with a copy of a second section of the original input frame delimited by demarcation lines 374*e* and 374*b*. The foregoing OLA thus results in a time-scaled frame which is formed entirely from the original input frame, and therefore does not rely on signal from an adjacent, or other, frame.

In the present implementation, the window length W1 is ¼ of the pitch period. It should be kept in mind, however, that other window lengths may also be used. Also, as seen in FIG. 8, the windows are preferably triangular in shape. However, other window shapes may be used instead, so long as the mixture of the two windows is appropriately scaled. Regardless of the shape or length of the window, the OLA helps ensure a smooth transition at the terminal end of the time-scaled frame.

After the OLA operation, the time-scaled frame is placed in an output buffer whose contents are subsequently passed to the speech encoder 156. After the pitch period is removed, the target count Tc is decremented by the pitch period (in samples) and the remaining count Rc is decremented by the pitch period. The ADR continues time-scale compression on additional input frames until the access delay is removed, e.g., until Rc is below the minimum allowed pitch period. For the rest of the talkspurt, the input frames are handled directly to the speech encoder. At the end of the time-scaling interval there may still be some residual delay. The maximum value of this residual delay is determined by the minimum allowable pitch period, which is Lmax of 20 samples, or 2.5 msec. On average, then, the residual delay is about half this amount, about 10 samples, or about 1.125 msec, which is reasonable for most systems. If required, the residual delay may be removed during an unvoiced segment of speech, where phase errors are not as noticeable. This, however, would increase the complexity of the implementation.

Additional short cuts are taken to lower the complexity of the implementation. For example, since a pitch period will never be removed from a frame if Tc<Lmin, no pitch estimate is calculated if Tc<20. Also, if the pitch period is low, it may be possible to remove two complete pitch periods from a single 20 msec frame, and this is allowed if Tc is more than twice the estimated pitch period. Furthermore, in the implementation, sample removal is always performed at the end of the most recent 20 msec frame.

The computational complexity of the implementation described above is dominated by the autocorrelation. The autocorrelation and overlap-add operations require a maximum of 5027 MACs, 108 compares, 55 divides, and 54 squar-root operators per iteration. Assuming MACs take one cycle, compares take 2 and divides and square-roots take 10 cycles, this yields total of 6333 cycles. The autocorrelation and OLA can be called once a frame. Thus, with a 20 msec frame size, this leads to a complexity estimate of approximately 0.3 MIP. The VAD is estimated to add another 0.1 MIP for a total of 0.45 MIP. Decreasing the frame size to 10 msec would increase the possible frequency of autocorrelations and OLAs by a factor to 2, leading to a total estimate of 0.8 MIP for 10 msec frames. Changing the degree of overlap, too, would also affect the computational complexity.

Attached as Appendix 1 is sample c++ source code for a floating-point implementation of an access delay reduction algorithm in accordance with the present invention.

While the above description is principally directed to wireless applications, such as cellular telephones, it should be kept in mind that time-scale compression of speech has applications in other settings, as well. In general, the principles of the present invention find use in any type of voice communication system in which statistical multiplexing of channels is performed. Thus, for example, the present invention may be of use in Digital Circuit Multiplication Equipment and also in Packet Circuit Multiplication Equipment, both of which are used to share voice channels in long distance cables, such as undersea cables.

And while the above invention has been described with reference to certain preferred embodiments, it should be kept in mind that the scope of the present invention is not limited to these. One skilled in the art may find variations of these preferred embodiments which, nevertheless, fall within the spirit of the present invention, whose scope is defined by the claims set forth below.

Appendix 1: Source Code for Sample Implementation of Access Delay Reduction Algorithm This section contains sample C++ source code for a floating-point version of the Access Delay Reduction algorithm. 5 files are listed.

| File | Description |
|---|---|
| pseudocode.c | Pseudo C++ code that shows how to call the ADR algorithm in an application. No implementations are given for many of the functions called in this code as they are system dependent. |

-continued

| File | Description |
|---|---|
| adr.h | Header file for the Access Delay Reduction algorithm. Includes declarations for both the public and private parts of the class. Internally, this class uses the CircularBuffer class. |
| adr.c | Implementation of the Access Delay Reduction algorithm. This file contains the heart of the algorithm and is the most important file included here. |
| circularbuffer.h | Include file for a circular First In First Out (FIFO) buffer. The CircularBuffer is used internally by adr.c. It is not called directly by the user and is included to clarify its use by the AccessDelayReduducer class. |
| circularbuffer.c | Implementation of the circular buffer. This file includes "libcoder.h" which is not shown here. The only function declared in libcoder.h is the error function, which halts the system on catastrophic errors. |

File:pseudocode.c

```
 1  /*
 2  * Copyright (C) 1999–2000 AT&T Corp.
 3  * All Rights Reserved.
 4  */
 5  #include <circularbuffer.h>
 6  #include <vad.h>
 7  #include <adr.h>
 8  /*
 9  * pseudo code for main processing loop with Access Delay Reduction algorithm.
10  * Read a frame's worth of audio, give it to both the VAD and ADR. When
11  * the VAD detects onset of activity, request a transmission channel. In
12  * the mean time the ADR buffers the speech. After the access delay, the
13  * ADR time-scales the beginning of the talkspurt until the access delay
14  * is gone. At the end of the talkspurt, the transmit channel is freed.
15  */
16  void processloop( )
17  {
18  int                     framesz = 160;      /* 20 msec at 8 KHz */
19  Float                   y[160];
20  bool                    activity, oldactivity = false;
21  bool                    adrdata, oldadrdata = false;
22  Vad                     vad(8000, 160);
23  AccessDelayReducer      adr(8000, 20., 60., 500.);
24  while (readinputframe(y, framesz)) {
25          activity = vad.activity(y);
26          /* request transmission channel at activity onset */
27          if (activity && !oldactivity)
28                  request_tx_channel( );
29          adrdata = adr.newframe(y, y, activity);
30          if (adrdata)
31                  encode_and_xmit(y, framesz);
32          /* free channel when ADR buffer has drained */
33          if (!adrdata && oldadrdata)
34                  free_tx_channel( );
35          oldactivity = activity;
36          oldadrdata = adrdata;
37      }
38  }
```

Pseudocode.c

The function processloop in pseudocode.c shows how the AccessDelayReducer class is used in an application. Here, we have decided to process the speech in increments of 160 samples, or 20 msec at 8 KHz sampling. On line 19 an array large enough to hold one frame's worth of floats is declared. The "Float" type is defined as a float with a typedef in the file circularbuffer.h. The bools on lines 20 and 21 keep track of the current and previous state of both the VAD and the ADR. An inactive to active transition detected by the VAD is used to request a transmission channel on lines 27 and 28. On lines 33–34, the end of available data for a talkspurt is used to relinquish the transmission channel. The constructor for the VAD on line 22 sets the VAD frame size to 160 samples and the samplerate to 8 KHz. The constructor call to the AccessDelayReducer on line 23 sets the samplerate to 8 KHz, the frame size to 20 msec, the access delay to 60 msec, and the interval for the time-scaling to 500 msec.

The loop on lines 24–37 reads in a frame of data and processes it. First, the VAD determines if there is activity on line 25. Next the frame is given to the ADR on line 29. The first argument is the input frame and the second argument is the output frame. In this example, the output from the ADR is placed in the same buffer used for input. The speech is buffered and delayed internally by the ADR. The call to newframe returns true if the output frame contains speech that should be transmitted (there is activity in it) and false otherwise. At the first few frames after an inactive to active transition in the VAD, e.g. for the duration of the access delay, newframe returns false even though the input frames contain active speech. After the access delay is over, the speech at the start of the talkspurt is returned. Newframe then starts time-scale compressing the speech until the access delay is removed.

Since the ADR may leave some residual delay or the talkspurt may be too short for the ADR to finish time-scaling, the output of the ADR determines when the transmission channel is returned rather than the VAD. All the active speech buffered in the ADR must be output before channel is returned.

File: adr.h

```
/*
Copyright (c) 1999–2000 AT&T Corp.
All Rights Reserved.
*
* Performing time-scaling compression at the start of a talkspurt
* in systems where there is access delay for channel allocation such
* as Voice over EDGE.
*/
class AccessDelayReducer {
public:
        AccessDelayReducer(int state, Float framesizems,
            Float accessdelayms, Float timescaleintervalms);
        ~AccessDelayReducer( );
bool    newframe(Float *in Float *out, bool active);
protected:
Float   frameszmsec;        /* frame size in msec */
Float   sysdelaymsec;       /* system contention delay, msec */
Float   timescalemsec;      /* interval for timescaling, msec */
Float   targetaccum;        /* target accumulator, samples */
Float   targetincr;         /* target increment, samples */
int     samplerate;         /* samplerate, Hz */
int     framesz;            /* frame size in samples */
int     activelen;          /* frames in current talk spurt */
int     sysdelayf;          /* system contention delay, frames */
int     sysdelay;           /* system delay, samples */
int     curdelay;           /* current delay, samples */
int     targetdelay;        /* target delay, samples */
int     timescalef;         /* timescaling interval, frames */
int     timescalefirstf;    /* first frame to start timescaling */
int     timescalelastf;     /* last frame to start timescaling */
int     ndec;               /* decimation factor */
int     pitchmin;           /* minimum pitch */
int     pitchmax;           /* maximum pitch */
int     pitchdiff;          /* pitch difference */
int     corrlen;            /* correlation length */
int     corrbuflen;         /* length of correlation buffer */
CircularBuffer              *outbuf;/* output buffer */
Float           *tmpbuf;    /* temporary scratch buffer */
Float           *corrbuf;   /* input buffer */
int     findbestmatch( );
void    updatecorrbuf(Float *s);
void    removedelay(Float *in, int pitch);
void    overlapadd(Float *1, Float *r, Float *o, int cnt);
void    idle( );
void    copy(Float *f, Float *t, int cnt);
void    zero(Float *s, int cnt);
};
```

File:adr.c

```
/*
* Copyright (c) 1999–2000 AT&T Corp.
* All Rights Reserved.
*/
#include <math.h>
#include "circularbuffer.h"
#include "adr.h"
#define  PITCH_MIN        .0025        /* minimum allowed pitch, 400 Hz */
#define  PITCH_MAX        .015         /* maximum allowed pitch, 66 Hz */
#define  NDEC_8K          2            /* 2:1 decimation at 8kHz */
#define  CORRMINPOWER     ((Float)250.) /* minimum power */
#define  CORRLEN          .020         /* 20 msec correlation length */
/*
* Constructor sets the samplerate, the frame size, the estimated access delay
* and the time-scaling interval. Appropriate length buffers are allocated
* based on these parameters.
*/
AccessDelayReducer::AccessDelayReducer(int srate, Float framesizems,
Float accessdelayms, Float timescaleintervalms)
{
samplerate = srate;
frameszmsec = framesizems;
sysdelaymsec = accessdelayms;
timescalemsec = timescaleintervalms;
ndec = (int)(NDEC_8K * samplerate / 8000.);
pitchmin = (int) (PITCH_MIN * samplerate);
pitchmax = (int) (PITCH_MAX * samplerate);
pitchdiff = pitchmax pitchmin;
corrlen = (int) (CORRLEN * samplerate);
corrbuflen = corrlen + pitchmax;
```

-continued

```
31  framesz = (int) (samplerate * frameszmsec * (Float) .001);
32  sysdelayf = (int)ceil(sysdelaymsec / frameszmsec);
33  sysdelay = sysdelayf * framesz;
34  timescalef = (int)ceil(timescalemsec / frameszm.sec) + 1;
35  timescalefirstf = sysdelayf + 1;
36  timescalelastf = sysdelayf + timescalef;
37  targetincr = (Float)sysdelay / (timescalef + 1);
38  corrbuf = new Float [corrbuflen];
39  outbuf = new CircularBuffer(framesz * (sysdelayf + 1));
40  tmpbuf = new Float(pitchmax >> 2);
41  activelen = 0;
42  idle( );
43  }
44  /*
45  * Free allocated resources in destructor.
46  */
47  AccessDelayReducer::~AccessDelayReducer ( )
48  {
49  delete [ ] tmpbuf;
50  delete outbuf;
51  delete [ ] corrbuf;
52  }
53  /*
54  * main public function for time-scaling sppech at start of talkspurt.
55  * Input is the speech from the audio port and active indicator from the
56  * VAD. Output is the speech delayed by the access delay, and then time-scaled
57  * to get remove the delay at the start of the talksprt.
58  * Newframe returns true if the returned frame should be transmitted and
59  * false if it should not be transmitted. For simulation purposes the
60  * returned frame of speech is set to zero if it should not be transmitted.
61  */
62  bool AccessDelayReducer::newframe(Float *in, Float *out, bool active)
63  {
64  bool r;
65  int pitch, cnt;
66  updatecorrbuf (in);
67  if (active) {
68          /* simulate contention delay at start of utterance */
69          if (++activelen <= sysdelayf) {
70                  /*
71                  * if delayed samples still left from last utterance
72                  * flush it. This shouldn't happen since if there
73                  * is some leftover delay, it should be output at
74                  * the first frame where the VAD determines there is
75                  * no activity.
76                  */
77                  if (activelen == 1 && outbuf->filled( ))
78                          outbuf->flush( );
79                  outbuf->write(in, framesz);
80                  curdelay += framesz;
81                  zero(out, framesz);
82                  r = false;
83          }
84          /* timescale at start of utterance */
85          else {
86                  /* update the current amount we allow to timescale */
87                  if (activelen <= timescalelastf) {
88                          /*
89                          * boost at first frame so targetaccum is
90                          * greater than pitchmin so its possible
91                          * to timescale at frame timescalefirstf.
92                          */
93                          if (activelen == timescalefirstf)
94                                  targetaccum = (Float)2. * targetincr;
95                          else
96                                  targetaccum += targetincr;
97                          targetdelay = (int)targetaccum;
98                          if (targetdelay > curdelay)
99                                  targetdelay = curdelay;
100                 }
101                 /*
102                 * if the target for delay removal is larger than
103                 * the minimum pitch, we can try to remove the delay.
104                 * We still may not be able to do it yet if the
105                 * estimated pitch is larger than the target delay.
106                 */
107                 if (targetdelay >= pitchmin &&
108                         (pitch = findbestmatch( )) <= targetdelay) {
109                                 removedelay(in, pitch);
```

-continued

```
110                         outbuf->read(out, framesz);
111                 }
112                 /*
113                 * either time-scaling isn't necessary, or not
114                 * possible because not enough time has passed,
115                 * or the current pitch is too long.
116                 * If outcnt is 0, all the delay has been removed
117                 * so we just copy the data from input to output.
118                 * Otherwise, there is still delay in the system
119                 * so the output must be buffered.
120                 */
121                 else if (outbuf->filled( ) == 0)
122                         copy(in, out, framesz);
123                 else {
124                         outbuf->write(in, framesz);
125                         outbuf->read(out, framesz);
126                 }
127                 r = true;
128         }
129 }
130 /* no speech activity detected */
131 else {
132         if (activelen != 0) {
133                 activelen = 0;
134                 idle( );
135         }
136                 /* if something left in delay buffer, output it */
137                 cnt = outbuf->filled( );
138                 if (cnt) {
139                         if (cnt >= framesz)
140                                 cnt = framesz;
141                         int left = framesz - cnt;
142                         outbuf->read(out, cnt);
143                         zero(&out[cnt], left);
144                         if (outbuf->filled( ) == 0)
145                                 idle( );
146                         r = true;
147                 } else {
148                         zero(out, framesz);
149                         r = false;
150                 }
151         }
152         return r;
153 }
154 /* remove the delay by timescale compressing the input */
155 void AccessDelayReducer::removedelay(Float *in, int pitch)
156 {
157         int     p2, pq, cnt, olacnt, ocnt;
158         /* see if we can remove more than one pitch period at a time */
159         p2 = pitch << 1;
160         if (p2 <= targetdelay && p2 <= pitchmax)
161                 pitch = p2;
162         pq = pitch >> 2;
163         olacnt = pitch + pq;
164         /* if the OLA fits in one frame, work directly on the input frame */
165         if (olacnt <= framesz) {
166                 cnt = framesz - olacnt;
167                 outbuf->write(in, cnt);
168                 overlapadd(&in[cnt], &in[cnt+pitch], tmpbuf, pq);
169                 outbuf->write(tmpbuf, pq);
170         }
171         /* Otherwise we have to copy some samples from the previous frame */
172         else {
173                 cnt = olacnt - framesz;
174                 ocnt = pq - cnt;
175                 outbuf->peektail(tmpbuf, cnt); /* from previous frame tail */
176                 copy(in, &tmpbuf[cnt], ocnt); /* from current frame */
177                 overlapadd(tmpbuf, &in[framesz - pq], tmpbuf, pq);
178                 outbuf->replacetail(tmpbuf, cnt); /* replace old tail */
179                 outbuf->write(tmpbuf, ocnt); /* write tail of OLA */
180         }
181         /* update the current delay variables */
182         targetaccum -= (Float)pitch;
183         targetdelay -= pitch;
184         curdelay -= pitch;
185 }
186 /* Initialized the time-scaling variables */
187 void AccessDelayReducer::idle( )
188 {
```

-continued

```
189         curdelay = 0;
190         targetdelay = 0;
191         targetaccum = 0.;
192 }
193 /* Save a frames worth of new speech into the correlation buffer */
194 void AccessDelayReducer::updatecorrbuf (Float *s)
195 {
196         int offset corrbuflen − framesz;
197         /* make room for new speech frame */
198         copy(&corrbuf[corrbuflen − offset], corrbuf, offset);
199         /* copy in the new frame */
200         copy(s, &corrbuf[offset], framesz);
201 }
202 /*
203 * Find the best match between the last segment of speech and
204 * the previous speech in the correlation buffer.
205 */
206 int AccessDelayReducer::findbestmatch( )
207 {
208         int         i, j, k;
209         int         bestmatch;
210         Float       bestcorr;
211         Float       corr;           /* correlation */
212         Float       energy;         /* running energy */
213         Float       scale;          /* scale correlation by average power */
214         Float       *rp;            /* segment to match */
215         Float       *1;
216         1 = &corrbuf[pitchmax];
217         /* coarse search */
218         rp = corrbuf;
219         energy = 0.f;
220         corr = 0.f;
221         for (i = 0; i < corrlen; i += ndec) {
222             energy += rp[i] * rp[i];
223             corr += rp[i] * 1[i];
224         }
225         scale = energy;
226         if (scale < CORRMINPOWER)
227             scale = CORRMINPOWER;
228         corr /= (Float)sqrt(scale);
229         bestcorr = corr;
230         bestmatch = 0;
231         for (j = ndec; j <= pitchdiff; j += ndec) {
232             energy −= rp[0] * rp[0];
233             energy += rp[corrlen] * rp[corrlen];
234             rp += ndec;
235             corr = 0.f;
236             for (i = 0; i < corrlen; i += ndec)
237                 corr += rp[i] * 1[i];
238             scale = energy;
239             if (scale < CORRMINPOWER)
240                 scale = CORRMINPOWER;
241             corr /= (Float)sqrt(scale);
242             if (corr >= bestcorr) {
243                 bestcorr = corr;
244                 bestmatch = j;
245             }
246         }
247         /* fine search */
248         j = bestmatch − (ndec − 1);
249         if (j < 0)
250             j = 0;
251         k = bestmatch + (ndec − 1);
252         if (k > pitchdiff)
253             k = pitchdiff;
254         rp = &corrbuf[j];
255         energy = 0.f;
256         corr = 0.f;
257         for (1 = 0; i < corrlen; i++) {
258             energy += rp[i] * rp[i];
259             corr += rp[i] * 1[i];
260         }
261         scale = energy;
262         if (scale < CORRMINPOWER)
263             scale = CORRMINPOWER;
264         corr = corr / (Float)sqrt(scale);
265         bestcorr = corr;
266         bestmatch = j;
267         for (j++; j <= k; j++) {
```

-continued

```
268                 energy -= rp[0] * rp[0];
269                 energy += rp[corrlen] * rp[corrlen];
270                 rp++;
271                 corr = 0.f;
272                 for (i = 0; i < corrlen; i++)
273                     corr += rp[i] * 1[i];
274                 scale = energy;
275                 if (scale < CORRMINPOWER)
276                     scale = CORRMINPOWER;
277                 corr /= (Float)sqrt(scale);
278                 if (corr > bestcorr) {
279                     bestcorr = corr;
280                     bestmatch = j;
281                 }
282             }
283             return pitchmax - bestmatch;
284 }
285 /* Overlap add with triangular windows */
286 void AccessDelayReducer::overlapadd(Float *1, Float *r, Float *o, int cnt)
287 {
288             Float incr = (Float)1. / cnt;
289             Float 1w = (Float)1. - incr;
290             Float rw = incr;
291             for (int i = 0; i < cnt; i++) {
292                 o[i] = 1w * 1[i] + rw * r[i];
293                 1w -= incr;
294                 rw += incr;
295             }
296 }
297 void AccessDelayReducer::copy(Float *f, Float *t, int cnt)
298 {
299             for (int i = 0; i < cnt; i++)
300                 t[i] = f[i];
301 }
302 void AccessDelayReducer::zero(Float *s, int cnt)
303 {
304             for (int i = 0; i < cnt; i++)
305                 s[i] = (Float)0.;
306 }
```

File:circularbuffer.h

```
1  /*
2  * Copyright (c) 1999–2000 AT&T Corp.
3  * All Rights Reserved.
4  *
5  * Circular buffer
6  */
7  typedef float Float;
8  class CircularBuffer {
9  public:
10                     CircularBuffer(int sz);
11                     ~CircularBuffer ( );
12 void                read(Float *f, int sz);
13 void                write(Float *f, int sz);
14 void                peekhead(Float *f, int sz);
15 void                peektail(Float *f, int sz);
16 void                replacehead(Float *f, int sz);
17 void                replacetail(Float *f, int sz);
18 void                flush( );
19 void                clear( );
20 int                 capacity( )        {return buflen;}
21 int                 filled( )          {return cnt;}
22 protected:
23 int                 buflen;            /* buffer size */
24 int                 cnt;               /* valid samples in buffer */
25 Float               *buf;              /* buffer */
26 Float               *bufe.             /* buffer end */
27 Float               *bufr;             /* buffer read pointer */
28 Float               *bufw;             /* buffer write pointer */
29 void                copy(Float         *f, Float *t, int cnt);
30 };
```

File:circularbuffer.c

```
1  /*
2  * Copyright (c) 1999–2000 AT&T Corp.
3  * All Rights Reserved.
4  */
5  #include "libcoder.h"
6  #include "circularbuffer.h"
7  CircularBuffer::CircularBuffer(int sz)
8  {
```

-continued

```
buflen = sz;
buf = new Float[buflen];
bufe = &buf[buflen];
flush( );
}
CircularBuffer::CircularBuffer( )
{
delete [ ] buf;
}
/* flush all data from the buffer */
void CircularBuffer::flush( )
{
bufr = bufw = buf;
cnt = 0;
}
/* fill the buffer with all zeros */
void CircularBuffer::clear( )
{
int        i;
bufr = bufw = buf;
cnt = buflen;
for (i = 0; i < buflen; i++)
        buf[i] = 0.;
}
/*
* Save data in the buffer. Its legal to write more data to the buffer
* than it can hold. In this case just the latest data is kept and the
* read pointer is updated.
*/
void CircularBuffer::write(Float *f, int sz)
{
        int left;
        cnt += sz;
        do {
                left = bufe - bufw;
                if (left > sz)
                        left = sz;
                copy(f, bufw, left);
                bufw += left;
                if (bufw == bufe)
                        bufw = buf;
                sz -= left;
                f += left;
        } while (sz);
        /*
        * if more data has been written than can fit,
        * update the read pointer so it reads the latest data.
        */
        if (cnt > buflen) {
                cnt = buflen;
                bufr = bufw;
        }
}
/* retrieve data from the buffer */
void CircularBuffer::read(Float *f, int sz)
{
        if (sz > cnt)
                ::error("CircularBuffer::read: read too large");
        cnt -= sz;
        int c = bufe - bufr;
        if (sz < c) {
                copy(bufr, f, sz);
                bufr += sz;
        } else {
                int c2 = sz - c;
                copy(bufr, f, c);
                copy(buf, &f[c], c2);
                bufr = &buf[c2];
        }
}
/*
* return the first sz samples at the head of
* the buffer without modifying the buffer
*/
void CircularBuffer::peekhead(Float *f, int sz)
{
        if (sz > cnt)
                ::error("CircularBuffer::peekhead: not enough data");
        int c = bufe - bufr;
```

-continued

```
88          if (sz <= c)
89              copy(bufr, f, sz);
90          else {
91              copy(bufr, f, c);
92              copy(buf, &f[c], sz - c);
93          }
94  }
95  /* replace the first sz samples at the head of the buffer */
96  void CircularBuffer::replacehead(Float *f, int sz)
97  {
98          if (sz > cnt)
99              ::error(CircularBuffer::replacehead: not enough data");
100         int c = bufe - bufr;
101         if (sz <= c)
102             copy(f, bufr, sz);
103         else {
104             copy(f, bufr, c);
105             copy(&f[c], buf, sz - c);
106         }
107 }
108 /*
109 * return the last sz samples in the tail of
110 * the buffer without modifying the buffer
111 */
112 void CircularBuffer::peektail(Float *f, int sz)
113 {
114         if (sz > znt)
115             ::error("CircularBuffer::peektail: not enough data");
116         int fromstart = bufw - buf;
117         if (sz > fromstart) {
118             int c = sz - fromstart;
119             copy(bufe - c, f, c);
120             f += c;
121             sz -= c;
122         }
123         copy(bufw - sz, f, sz);
124 }
125 /* replace the last sz samples in the tail of the buffer */
126 void CircularBuffer::replacetail(Float *f, int sz)
127 {
128         if (sz > cnt)
129             ::error("CircularBuffer::replacetail: not enough data");
130         int fromstart = bufw - buf;
131         if (sz > fromstart) {
132             int c = sz - fromstart;
133             copy(f, bufe - c, c);
134             f += c;
135             sz -= c;
136         }
137         copy(f, bufw - sz, sz);
138 }
139 void CircularBuffer::copy(Float *f, Float *t, int cnt)
140 {
141         for (int i = 0; i < cnt; i++)
142             t[i] = f[i];
143 }
```

What is claimed is:

1. A communication device configured to operate in a discontinuous transmission packet telephony network having a channel access delay, the communication device comprising:

an access delay reducer configured to remove a first portion of a frame of an input voice signal to form a time-scaled frame, the first portion comprising an integer number of a pitch period's worth of the input voice signal, the access delay reducer being further configured to form an overlap-added segment at an end portion of the time-scaled frame, wherein:

the overlap-added segment is formed from a first segment of the frame, the first segment located immediately before the first portion, and a second segment of the frame, the second segment comprising an endmost portion of a terminal section of the frame.

2. The communication device according to claim 1, wherein the access delay reducer is configured to remove the first portion from a terminal section of said frame.

3. The communication device according to claim 1, wherein the first and second segments are each multiplied by a window and added together to form the overlap-added segment.

4. The communication device according to claim 1, wherein the access delay reducer is configured to remove a first portion from a corresponding frame for each talkspurt of a call.

5. The communication device according to claim 1, wherein the access delay reducer is configured to remove the first portion from the frame, even if the first portion comprises unvoiced speech.

6. A method for processing a speech signal for transmission over a network, the method comprising:

(a) receiving an input frame of a speech signal; and (b) removing an integer number of a pitch period's worth of the speech signal from the input frame to form a time-scaled frame, wherein:

the speech signal is compressed to reduce an access delay, an end portion of the time-scaled frame comprises an overlap-added segment, and the overlap-added segment is formed from a first segment of the input frame, the first segment located immediately before the removed portion and a second segment of the input frame, the second segment comprising an endmost portion of a terminal section of the input frame.

7. The method of claim 6, further wherein the time-scaled frame is a compressed time-scaled frame.

8. The method of claim 7, further comprising:

(c) repeating steps (a) and (b) until a plurality of compressed time-scaled frames corresponds to the access delay.

9. The method of claim 6, wherein a new pitch period is calculated for each frame of voice signal from which a corresponding first portion is cut.

10. The method of claim 6, further comprising:

establishing a time interval over which the access delay is to be mitigated, wherein the time interval is longer than the access delay.

11. The method of claim 6, further comprising:

establishing a value governing a rate at which the access delay is mitigated.

12. The method of claim 6, wherein steps (a)–(b) are performed for each talkspurt of a call.

13. The method of claim 6, wherein the removed portion of the speech signal is removed from a terminal section of the input frame.

14. The method of claim 6, wherein the first and second segments are each multiplied by a window and added together to form the overlap-added segment.

15. The method of claim 6, wherein the integer number of a pitch period's worth of the speech signal is removed even if the integer number of the pitch period's worth of the speech signal comprises unvoiced speech.

16. The method of claim 6, wherein the access delay is a channel access delay for the network.

17. The method of claim 6, wherein the access delay is due to a delay associated with a voice activity detector.

* * * * *